US005155090A

United States Patent [19]

Aono et al.

[11] Patent Number: 5,155,090

[45] Date of Patent: Oct. 13, 1992

[54] THERMAL TRANSFER IMAGE RECEIVING MATERIAL

[75] Inventors: Toshiaki Aono; Takeo Sakai, both of Kanagawa, Japan

[73] Assignee: Fuji Photo Film Co., Ltd., Kanagawa, Japan

[21] Appl. No.: 571,696

[22] Filed: Aug. 24, 1990

[30] Foreign Application Priority Data

Aug. 24, 1989 [JP] Japan ..... 1-216122

[51] Int. Cl.[5] ..... B41M 5/035; B41M 5/26

[52] U.S. Cl. ..... 503/227; 428/195; 428/327; 428/335; 428/336; 428/913; 428/914

[58] Field of Search ..... 8/471; 428/195, 913, 428/914, 335, 336, 327; 427/146; 503/227

[56] References Cited

U.S. PATENT DOCUMENTS 4,962,080 10/1990 Watanabe ..... 503/227

FOREIGN PATENT DOCUMENTS 63-013782 1/1988 Japan ..... 428/195

1-222985 9/1989 Japan ..... 428/195

*Primary Examiner*—B. Hamilton Hess

*Attorney, Agent, or Firm*—Sughrue, Mion, Zinn, Macpeak & Seas

[57] ABSTRACT

A thermal transfer image receiving material is disclosed, comprising a support having thereon at least one image receiving layer capable of accepting a dye which migrates from a thermal transfer dye providing material when heated, to form an image, wherein the image receiving layer is formed by coating a coating solution and drying it, the coating solution being obtained by dispersing an aqueous solution of fine particles of a dye accepting polymer and a high-boiling organic solvent and/or a thermal solvent in a water-soluble binder solution.

13 Claims, No Drawings

THERMAL TRANSFER IMAGE RECEIVING MATERIAL

FIELD OF THE INVENTION

This invention relates to a thermal transfer image receiving material for use in a thermal transfer method using thermomobile type dyes. More particularly, it relates to a thermal transfer image receiving material which is excellent in manufacturability, gives a high transfer density, does not cause fusion by heat and gives an image of excellent quality.

BACKGROUND OF THE INVENTION

Various information processing systems have been developed as a result of the rapid development which has taken place in the information industry in recent years. Methods of recording and apparatus compatible with these information processing systems have been developed and adopted. Thermal transfer recording methods, i.e., recording methods of this type, involve the use of an apparatus which is light and compact, with which there is little noise, and which has excellent operability and maintenance characteristics. Moreover, since they also allow coloring to be achieved easily, these methods are the most widely used. Thermal transfer recording methods can be broadly classified into two types, namely, thermofusion types and thermomobile types. In the latter case, a thermal transfer dye providing material which has, on a support, a dye providing layer which contains a binder and a thermomobile dye is laminated with a thermal transfer image receiving material, heat is applied from the support side of the dye providing material, the thermomobile dye is transferred to the recording medium (thermal transfer image receiving material) in the form of a pattern corresponding to the heat pattern which has been applied and an image is formed.

Moreover, a thermomobile dye is, for example, a dye which can be transferred from a thermal transfer dye providing material to a thermal transfer image receiving material by sublimation or diffusion in a medium.

However, the following disadvantages are encountered with thermal transfer image receiving materials in which the thermomobile type thermal transfer recording method is employed.

The polymers used in the receiving layer for the thermomobile dye are soluble in organic solvents and so an organic solvent system is used for the receiving layer coating liquid. Furthermore, the apparatus and vessels used , in the manufacturing process must be cleaned with organic solvents. Hence, the apparatus used for preparing the coating liquid and the coating apparatus must be explosion-proof. Furthermore, organic solvents are very expensive when compared to water and so the production costs are increased. Moreover, problems can arise with the health supervision of the operators. As stated above, conventional thermal transfer image materials using organic solvents have various problems with regard to the adoptability for the production thereof.

Various attempts have been made to obtain an image having a high transfer density in the thermomobile type thermal transfer image receiving method.

For example, JP-A-60-38192 (the term "JP-A" as used herein means an "unexamined published Japanese patent application") discloses the use of latexes of dye accepting polymers as coating solutions for the image receiving layer. However, the resulting image is not considered to be satisfying with respect to transfer density, because the transfer density is low. Further, when the thermal transfer image receiving material is placed on the thermal transfer dye providing material and heat is applied thereto to transfer the thermomobile dye from the dye providing material to the image receiving material in the method described in the above patent specification, problems are often caused in that both materials are fused together by heat, and the dye providing layer of the dye providing material is peeled off and stuck on the transfer surface of the image receiving material, or conveying is sometimes made impossible and the printer is stopped. These troubles are caused particularly when the applied voltage is raised and thermal transfer is carried out at high temperatures to obtain a sufficient transfer density. Further, when additives are used to increase the transfer density of the thermal transfer image receiving material or to prevent heat fusion from being caused, it has been found that the image quality of the image receiving material is liable to be deteriorated.

JP-A-57-137191, JP-A-57-91296 and JP-A-60-38192 disclose that the dispersions of the latexes of dye accepting polymers in polyvinyl alcohol (PVA), polyvinyl pyrrolidone (PVP) or hydroxyethyl cellulose (HEC) are used as coating solutions for the image receiving layer to improve image density. It has been found that an effect of improving image density is somewhat obtained. However, the effect is low and insufficient.

The present inventors have made studies to solve the above-described problems caused when the organic solvent solutions of the dye accepting materials are coated.

SUMMARY OF THE INVENTION

An object of the present invention is to provide a thermal transfer image receiving material which is freed from the problems associated with the prior art and gives an image having a high transfer density.

Another object of the present invention is to provide a thermal transfer image receiving material which has improved properties with regard to the problem of the heat fusion of the image receiving material with the dye providing material during thermal transfer.

The above-described objects of the present invention have been achieved by providing a thermal transfer image receiving material comprising a support capable of accepting a dye which migrates from a thermal transfer dye providing material when heated, to form an image, wherein the image receiving layer is formed by coating a coating solution and drying it, the coating solution being obtained by dispersing an aqueous dispersion of fine particles of a dye accepting polymer and a high-boiling organic solvent and/or a thermal solvent in a water-soluble binder solution.

DETAILED DESCRIPTION OF THE INVENTION

In the present invention, the organic solvent solution of the dye accepting substance is not coated as in the past, but the dye accepting substance is dispersed in a water-soluble binder and coated. Accordingly, coating can be carried out by using water as a solvent in the present invention. Thus, there is no risk of explosion, the manufacturing costs can be markedly reduced and adverse effects on operator health are greatly reduced.

Further, when the image receiving layer is prepared by dispersing the high-boiling organic solvent or thermal solvent in an aqueous dispersion of fine particles of the dye accepting polymer without using the water-soluble binder, coating the resulting coating solution and drying it, the film of the image receiving layer becomes sticky and fusion by heat is liable to be caused during thermal transfer, while when the image receiving layer is prepared by dispersing an aqueous dispersion of fine particles of the dye accepting polymer and the dye accepting high-boiling organic solvent and/or thermal solvent in the water-soluble binder solution, coating the resulting coating solution and drying it as in the present invention, the image receiving layer can sufficiently accept the thermomobile dye, an image having a high transfer density can be obtained, and the problem of fusion by heat during thermal transfer is eliminated. This is an unexpected finding.

Furthermore, when the dye image receiving layer is composed of two or more multi-layers, the coating-drying stage must be repeated several times in the methods using conventional organic solvent coating solutions. In the present invention, the coating solution for the image receiving layer is the water-soluble binder solution and by which simultaneous multilayer coating can be accomplished. Accordingly, the present invention has advantages in that the manufacturing process can be shortened and the manufacturing cost can be reduced.

Now, the present invention will be illustrated in more detail below.

The thermal transfer image receiving material of the present invention is provided with an image receiving layer capable of accepting a dye. The image receiving layer contains a dye accepting substance carried thereon and dispersed in a water-soluble binder, the dye accepting substance having a function capable of accepting a thermomobile dye migrating from a thermal transfer dye, providing material during printing and allowing the thermomobile dye to be deposited.

In the present invention, the image receiving layer is prepared by dispersing an aqueous dispersion of the fine particles of the dye accepting polymer and the dye accepting high-boiling organic solvent and/or thermal solvent in the water-soluble binder solution, coating the resulting coating solution and drying it.

Examples of the coating solution for the image receiving layer, which can be used in the present invention, include:

(a) a composition obtained by emulsifying and dispersing (1) an aqueous dispersion of the fine particles of the dye accepting polymer and (2) the dye accepting high-boiling organic solvent and/or thermal solvent, or a low-boiling organic solvent solution of them, in water or an aqueous solution of a water-soluble polymer and then mixing the resulting dispersion with (3) an aqueous solution of the water-soluble binder;

(b) a composition obtained by using a mixed solution of (1) an aqueous dispersion of the fine particles of the dye accepting polymer and (3) an aqueous solution of the water-soluble binder as a dispersion medium and emulsifying and dispersing (2) the dye accepting high-boiling organic solvent and/or thermal solvent, or a low-boiling organic solvent solution of them, in the mixed solution; and (c) a composition obtained by dispersing (1) an aqueous solution of the fine particles of the dye accepting polymer and (2) the dye accepting high-boiling organic solvent and/or thermal solvent in an aqueous solution of the water-soluble binder, without using a low-boiling organic solvent solution, and then mixing the resulting dispersion with (3) an aqueous solution of the water-soluble binder.

The aqueous solution of the fine particles of the dye accepting polymer which is used in the present invention is a dispersion of the fine particles of the dye accepting polymer in water. The fine particles of the polymer have a particle diameter of preferably not larger than 5 μm. More preferably, the polymer is in the form of a latex (particle diameter of not larger than 1 μm).

Examples of the aqueous solution of the fine particles of the dye accepting polymer include those obtained by dissolving a dye accepting polymer in an organic solvent, emulsifying and dispersing the resulting solution in water and removing the organic solvent; and latexes obtained by emulsion polymerizing a dye accepting polymer.

Examples of the dye accepting polymer include the following resins.

(I) Resins having an ester linkage

Polyester resins obtained by the condensation of a dicarboxylic acid component such as terephthalic acid, isophthalic acid or succinic acid (the dicarboxylic acid component may be substituted by a sulfo group, a carboxyl group, etc.) with ethylene glycol, diethylene glycol, propylene glycol, neopentyl glycol, bisphenol A or the like; polyacrylate resins and polymethacrylate resins such as polymethyl methacrylate, polybutyl methacrylate, polymethyl acrylate and polybutyl acrylate; polycarbonate resins; polyvinyl acetate resins; styrene-acrylate resins; vinyltoluene acrylate resins, etc. More specifically, examples of the resins are described in JP-A-59-101395, JP-A-63-7971, JP-A-63-7972, JP-A 63-7973 and JP-A-60-294862. Examples of commercially available resins which can be used in the present invention include Vylon 290, Vylon 200, Vylon 280, Vylon 300, Vylon 103, Vylon GK-140 and Vylon GK-130 (products of Toyobo Co., Ltd.) and ATR-2009 and ATR-2010 (products of Kao Corporation).

(II) Resins having an urethane linkage

Polyurethane resins, etc.

(III) Resins having an amido linkage

Polyamide resins, etc.

(IV) Resins having an urea linkage

Urea resins, etc.

(V) Resins having a sulfone linkage

Polysulfone resins, etc.

(VI) Resins having linkages with high polarity

Polycaprolactone resins, styrene-maleic anhydride resins, polyvinyl chloride resins, polyacrylonitrile resins, etc.

In addition to the above-described synthetic resins, mixtures thereof and copolymers thereof can also be used.

Examples of the aqueous solution of the fine particles of the dye accepting polymer which is commercially available include Vylonal MD-1200 (a product of Toyobo Co., Ltd.) and Pesresin (a product of Takamatsu Yushi KK).

Now, the dye accepting high-boiling organic solvent and/or thermal solvent will be illustrated in detail below.

Examples of the high-boiling organic solvent include compounds such as esters (e.g., phthalic esters, phosphoric esters, fatty acid esters), amides (e.g., fatty acid amides, sulfonamides), ethers, alcohols, paraffins and silicone oils as described in JP-A-59-83154, JP-A-59-

178451, JP-A-59-178452, JP-A-59-178453, JP-A-59-178454, JP-A-59-178455, and JP-A-59-178457.

As the thermal solvent, there can be used compounds having such properties that (1) the compounds are compatible with dyes, (2) the compounds are solids at room temperature and can be molten (may be molten by aid of other component mixed therewith) when heated by a thermal head during transfer and (3) the compounds are not decomposed when heated by a thermal head. Compounds having a melting point of 35° to 250° C., particularly 35° to 200° C., are preferred.

Compounds having an (organic character/inorganic character) value ≧2, preferably 2 or more but less than 6, are preferred as the high-boiling organic solvents and the thermal solvents. If the (organic character/inorganic character) value is less than 2, the dispersibility is poor, and the surface gloss of the image receiving material is lowered. On the other hand, if it is 6 or more, the increasing effect of transfer density is little. The terms "organic character" and "inorganic character" as used herein refer to a conception for foreseeing the properties of compounds. The details thereof are described in *Field of Chemistry,* 11, page 719 (1957).

Examples of the high-boiling organic solvents and thermal solvents are included compounds described in JP-A-62-174754, JP-A-62-245253, JP-A-61-209444, JP-A-61-200538, JP-A-62-8145, JP-A-62-9348, JP-A-62-30247 and JP-A-62-136646.

More specifically, examples of the high-boiling organic solvents and thermal solvents include, but are not limited to, the following compounds. The (organic character/inorganic character) values of these compounds are also listed in the parentheses together with the formulae of these compounds below.

Compound 1

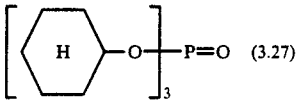

(3.27)

Compound 2

$(n\text{-}C_{18}H_{37}O)_3P{=}O$ (13.5)

Compound 3

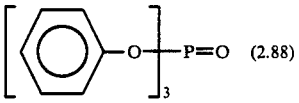

(2.88)

Compound 4

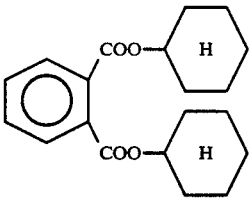

(2.58)

Compound 5

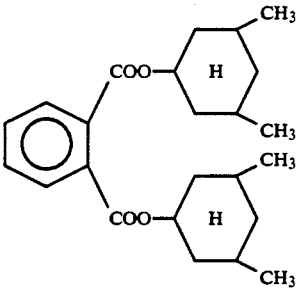

(3.10)

Compound 6

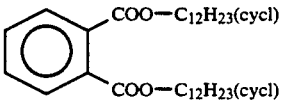

(4.13)

Compound 7

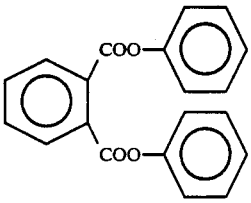

(2.42)

-continued
Compound 8
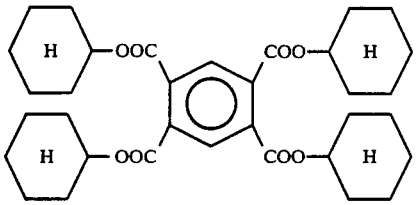
(2.31)
Compound 9
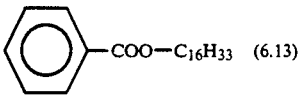
(6.13)
Compound 10
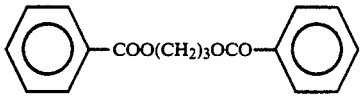
(2.27)
Compound 11
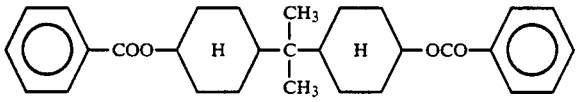
(3.41)
Compound 12
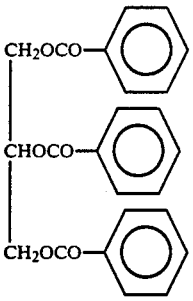
(2.13)
Compound 13
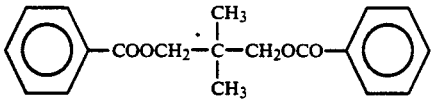
(2.53)
Compound 14
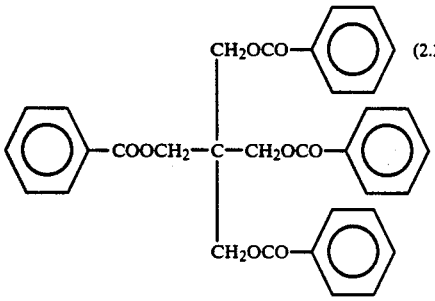
(2.2)
Compound 15
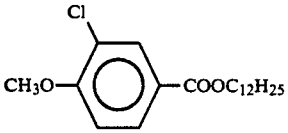
(4.19)
Compound 16
n-$C_{17}H_{35}COOCH_3$ (6.33)
Compound 17
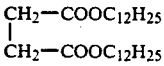
(4.67)

-continued
Compound 18
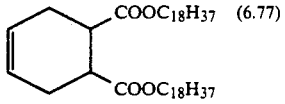
(6.77)
Compound 19
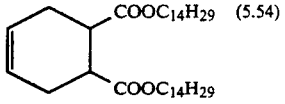
(5.54)
Compound 20
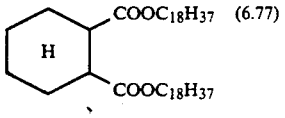
(6.77)
Compound 21
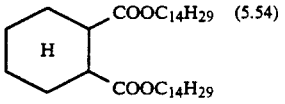
(5.54)
Compound 22
$C_{15}H_{31}COOC_{16}H_{33}$ (10.67)
Compound 23
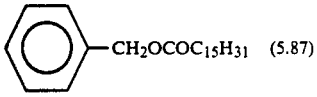
(5.87)
Compound 24
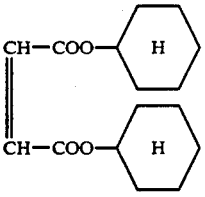
(2.25)
Compound 25
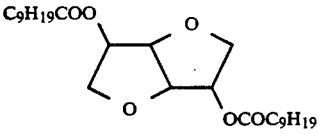
(3.71)
Compound 26
$CH_2OCOC_{17}H_{35}(n)$ (6.33)
|
$CHOCOC_{17}H_{35}(n)$
|
$CH_2OCOC_{17}H_{35}(n)$
Compound 27
$CH_2OCOC_{11}H_{33}(n)$ (4.33)
|
$CHOCOC_{11}H_{33}(n)$
|
$CH_2OCOC_{11}H_{33}(n)$
Compound 28
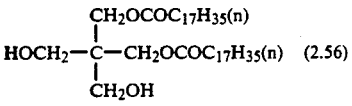
(2.56)
Compound 29
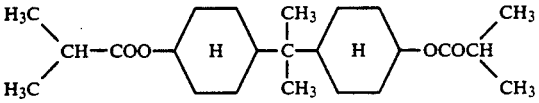
(3.29)
Compound 30
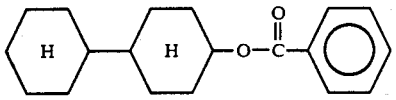
(4.00)

-continued

Compound 31

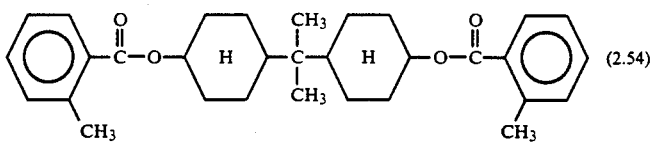
(2.54)

Compound 32

$(C_{12}H_{25}O)_3P{=}O$ (5.69)

Compound 33

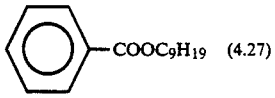
(4.27)

Compound 34

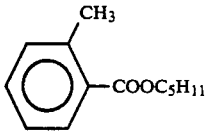
(3.46)

Compound 35

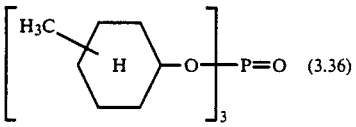
(3.36)

Compound 36

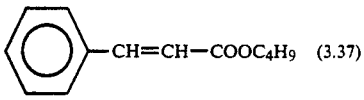
(3.37)

Compound 37

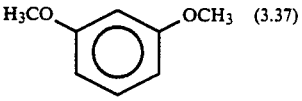
(3.37)

Compound 38

$C_7H_{15}CO(CH_3)_2$ (1.48)

Compound 39

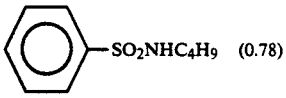
(0.78)

Among these compounds, Compounds 1 to 22, 24, 26 to 31 and 39 can be used as the thermal solvent; and Compounds 23, 25 and 32 to 38 can be used as the high-boiling organic solvent, respectively.

The above-described high-boiling organic solvents and thermal solvents may be used for the purpose of improving slipperiness, releasability and curl balance.

The image receiving layer of the thermal transfer image receiving material of the present invention comprises the dye accepting substance dispersed in the water-soluble binder. Any of the conventional water-soluble polymers can be used as the water-soluble binder. However, water-soluble polymers having a group capable of crosslinking in the presence of a hardening agent are preferred.

Examples of the water-soluble polymers which can be used in the present invention include vinyl polymers and derivatives thereof such as polyvinyl alcohol, polyvinyl pyrrolidone, polyvinyl pyridinium and cationic modified polyvinyl alcohol (described in JP-A-60-145879, JP-A-60-220750, JP-A-61-143177, JP-A-61-235182, JP-A 61-245183, JP-A-61-237681 and JP-A-61-261089); polymers having an acrylic group such as polyacrylamide, polydimethyl acrylamide, polydimethylamino acrylate, polyacrylic acid and salts thereof, acrylic acid-methacrylic acid copolymers and salts thereof, polymethacrylic acid and salts thereof and acrylic acidvinyl alcohol copolymers and salts thereof (described in JP-A 60-168651 and JP-A-62-9988); natural polymers and derivatives thereof such as starch, oxidized starch, acetyl starch, amine starch, carboxyl starch, dialdehyde starch, cationic starch, dextrin, sodium alginate, gelatin, gum arabic, casein, pullulan, dextran, methyl cellulose, ethyl cellulose, carboxymethyl cellulose, hydroxyethyl cellulose and hydroxypropyl cellulose (described in JP-A-59-174382, JP-A-60-262685, JP-A-61-143177, JP-A-61-181679, JP-A-61-193879 and JP-A-61-287782); synthetic polymers such as polyethylene glycol, polypropylene glycol, polyvinylmethyl ether, maleic acid-vinyl acetate copolymer, maleic acid-N-vinylpyrrolidone copolymer, maleic acid-alkylvinyl ether copolymers and polyethyleneimine (described in JP-A-61-32787, JP-A-61-237680 and JP-A-61-277483); and water-polymers described in JP-A-56-58869.

Copolymers which are solubilized in water by monomers having an $SO_3^{\ominus}$ group, a $COO^{\ominus}$ group, an $SO_2^{\ominus}$ group or the like can be used.

It is particularly preferred that gelatin is used as the water-soluble binder, because set drying is possible and hence the drying load can be greatly reduced and simultaneous multi-layer coating can be easily carried out. Examples of gelatin include gelatin and derivatives thereof such as lime-processed gelatin, lime-processed gelatin having been subjected to a calcium removal treatment, acid-processed gelatin, phthalated gelatin, acetylated gelatin and succinated gelatin; and enzyme-processed gelatin, hydrolyzates of gelatin and enzymatic hydrolyzates of gelatin described in *Bull. Soc. Phot. Japan,* No. 16, p. 30 (1966).

These water-soluble polymers may be used either alone or in a combination of two or more of them.

The water-soluble binder and the finely divided dye accepting polymer are used in a weight ratio of the dye accepting polymer to the water soluble polymer of from 1 to 20, preferably from 2 to 10, particularly preferably from 2.5 to 7.

The dye accepting high-boiling organic solvent and/or thermal solvent are/is used in an amount of 1 to 300% by weight, preferably 10 to 200% by weight, particularly preferably 30 to 150% by weight, based on the amount of the water soluble binder.

The dye accepting substance can be dispersed in the water-soluble binder by any of the conventional dispersion methods for dispersing hydrophobic substances in water-soluble polymers. Typical examples thereof include a method wherein a solution of the dye accepting substance dissolved in a water immiscible organic solvent is mixed with an aqueous solution of the water-soluble binder to carry out emulsification and dispersion, and a method wherein a latex of the dye accepting polymer is mixed with an aqueous solution of the water-soluble binder.

The image receiving layer may be composed of one layer or two or more layers. When the image receiving layer is composed of two or more layers, it is preferred that a synthetic resin having a lower glass transition point or the high-boiling organic solvent or thermal solvent is used for the image receiving layer closer to the support to increase dyeability with the dye and a synthetic resin having a higher glass transition point or a fluoro-compound is used for the outermost layer to minimize the amount of the high-boiling organic solvent or thermal solvent, whereby troubles such as sticking on the surface of the layer, adhesion to other substances, re-transfer of transferred dye to other substance and blocking with the thermal transfer dye providing material are prevented from being caused. It is preferred that the release agent described hereinafter is incorporated in the outermost layer.

The total thickness of the image receiving layer is in the range of preferably 0.5 to 50 μm, particularly preferably 3 to 30 μm. When the image receiving layer is composed of two or more layers, the thickness of the outermost layer is in the range of preferably 0.1 to 3 μm, particularly preferably 0.2 to 1.5 μm.

Any of the supports conventionally used for thermal transfer image receiving materials can be used in the present invention without particular limitation. Materials in which thermomobile dyes are highly diffusible can be used as the supports in the present invention.

Examples of the supports include (1) synthetic paper (e.g., polyolefin or polystyrene synthetic paper), (2) paper supports such as wood-free paper, art paper, coated paper, cast coated paper, wall paper, backing paper, synthetic resin or emulsion-impregnated paper, synthetic rubber latex-impregnated paper, paper containing a synthetic resin internally added, cardboard, cellulose fiber paper and polyolefin-coated paper (particularly paper whose both sides are coated with polyethylene); and (3) plastic films or sheets such as films or sheets of polyolefins, polyvinyl chloride, polyethylene terephthalate, polystyrene, methacrylates and polycarbonates and films or sheets thereof having been treated to impart white color reflecting properties.

Laminates composed of a combination of two or more of the above materials (1) to (3) can be used.

Among them, polyolefin-coated paper is preferred, because the polyolefin-coated paper does not cause recessed deformation by heat during thermal transfer, has excellent whiteness and scarcely causes curling.

Polyolefin-coated paper is described in, for example, *Foundation of Photographic Engineering* (*Silver Salt Photography Part*), pp. 223–240 (1979) (published by Corona). The polyolefin-coated paper comprises basically a support sheet and a polyolefin layer coated on the support sheet. The support sheet is composed of a material other than synthetic resins and is generally composed of wood-free paper. A polyolefin coat may be provided by any method, so long as the polyolefin layer adheres closely to the surface of the support sheet. However, the polyolefin coat is generally provided by extrusion coating. The polyolefin layer may be provided only on the surface of the image receiving layer side of the support sheet. If desired, the polyolefin layer may be provided on both sides of the support sheet. Any of the high-density polyethylenes, low density polyethylenes and polypropylenes can be used as the polyolefin. However, it is preferred from the viewpoint of heat insulation effect that low-density polyethylenes having a low thermal conductivity are used for the side on which the image receiving layer is provided.

There is no particular limitation with regard to the thickness of the polyolefin coat. However, the thickness of one side is preferably 5 to 100 μm. It is preferred that the thickness of the polyolefin coat on the image receiving layer side is thinner to obtain a higher transfer density.

A pigment such as titanium oxide or ultramarine or a filler may be added to the polyolefin coat to increase whiteness. A thin gelatin layer in a coating weight of about 0.05 to 0.4 $g/m^2$ may be provided on the surface (the side on which the image receiving layer is provided and/or the back side thereof) of polyolefin-coated paper.

The thermal transfer image receiving layer of the present invention may be provided with an interlayer with or without a water-soluble binder between the support and the image receiving layer.

The interlayer may be a cushioning layer, a porous layer or a layer for preventing the dye from diffusing depending on the qualities of the materials which constitute the interlayer. The interlayer may be a layer having two or more functions. If desired, the interlayer may have a function as an adhesive in addition to the above functions.

The layer for preventing the dye from diffusing plays a role in preventing the thermomobile dye in particular from diffusing into the support. Any of the water-soluble binders or organic solvent-soluble binders may be used as a binder for the diffusion preventing layer. However, the water-soluble binder is preferred. Examples of the water soluble binder include those for the image receiving layer. Gelatin is particularly preferred.

The porous layer is a layer which prevents the heat applied during thermal transfer from diffusing from the image receiving layer into the support to effectively utilize the heat applied.

When the water-soluble binder is used as the binder for the porous layer, the layer can be formed by (1) a method wherein porous fine particles are dispersed in a water-soluble polymer and the dispersion is coated and dried; (2) a method wherein a solution of a water-soluble polymer is mechanically stirred to form bubbles and the solution is coated and dried; (3) a method wherein a blowing agent is added to a water-soluble polymer solution and the solution is foamed before coating and then coated or the solution is foamed during the course of coating and drying; or (4) a method wherein an organic solvent (preferably a solvent having a boiling point higher than that of water) is emulsified and dispersed in a water-soluble polymer solution and microvoids are formed during the course of coating and drying.

When the organic solvent-soluble binder is used as the binder for the porous layer, the layer can be formed, for example, by (1) a method wherein an emulsion of a synthetic resin such as polyurethane or a synthetic rubber latex such as methyl methacrylate-butadiene rubber latex is mechanically stirred to form bubbles and the resulting liquid is coated on the support and dried; (2) a method wherein a blowing agent is mixed with the above-described synthetic resin emulsion or synthetic rubber latex and the resulting liquid is coated on the support and dried; (3) a method wherein a blowing agent is mixed with a synthetic resin such as vinyl chloride plastisol or polyurethane or a synthetic rubber such as styrene-butadiene rubber and the resulting liquid is coated on the support and dried; or (4) a method wherein a solution of a thermoplastic resin or a synthetic rubber dissolved in an organic solvent is mixed with a non-solvent (including a non-solvent mainly composed of water) which evaporates difficultly in comparison with the organic solvent, is compatible with the organic solvent and does not dissolve the thermoplastic resin or synthetic rubber, and the resulting mixed solution is coated on the support and dried to form a microporous layer.

When the image receiving layer is provided on both sides of the support, the interlayer may be provided on both sides thereof or on only one side thereof. The thickness of the interlayer is 0.5 to 50 μm, particularly preferably 1 to 20 μm.

The image receiving layer, the cushioning layer, the porous layer, the diffusion preventing layer and the adhesive layer which constitute the thermal transfer image receiving material of the present invention may contain a fine powder of silica, clay, talc, diatomaceous earth, calcium carbonate, calcium sulfate, barium sulfate, aluminum silicate, synthetic zeolite, zinc oxide, lithopone, titanium oxide or alumina.

The thermal transfer image receiving material may contain fluorescent brighteners. Examples thereof include compounds described in K. Veenkataraman, *The Chemistry of Synthetic Dyes,* Vol. 5, 8th chapter and JP-A-61-143752. More specifically, examples of the fluorescent brighteners include stilbene compounds, coumarin compounds, biphenyl compounds, benzoxazolyl compounds, naphthalimide compounds, pyrazoline compounds, carbostyryl compounds and 2,5-benzoxazolethiophene compounds.

The fluorescent brighteners may be used in combination with anti-fading agents.

The thermal transfer dye providing material comprises a support having thereon a thermal transfer layer containing a thermomobile dye. Recording is made by applying heat thereto and allowing the dye in the form of a pattern to migrate into the image receiving layer of the thermal transfer image receiving material.

Any of the conventional supports can be used as the supports for the thermal transfer dye providing material. Examples of the supports include polyethylene terephthalate, polyamides, polycarbonates, glassine paper, condenser paper, cellulose esters, fluoropolymers, polyethers, polyacetals, polyolefins, polyimides, polyphenylene sulfide, polypropylene, polysulfone and cellophane.

The support of the thermal transfer dye providing material has generally a thickness of from 2 to 30 μm. If desired, the support may be provided with a subbing layer. A layer for preventing the dye from diffusing, which is composed of a hydrophilic polymer, may be provided between the support and the dye providing layer, whereby transfer density can be further improved. The above-described water-soluble polymers can be used as hydrophilic polymers for the diffusion preventing layer.

A stripping layer may be provided to prevent the dye providing material from being stuck on the thermal head. The stripping layer comprises a lubricating substance which contains or does not contain a polymer binder, such as a surfactant, a solid or liquid lubricant or a mixture thereof.

The dye providing layer contains a dye which is chosen so as to allow a desired hue to be transferred when printed. If desired, two or more dye providing layers having different dyes may be arranged on one thermal transfer dye providing material. For example, when an image like a color photograph is formed by repeatedly making printing having each color according to progressive signals, it is desirable that printed hues have each color of cyan, magenta and yellow and three dye providing layers containing dyes giving such hues are arranged. If desired, a dye providing layer containing a dye giving a black hue may be arranged in addition to the dye providing layers containing dyes giving cyan, magenta and yellow hues. It is preferred that when these dye providing layers are formed, a mark for position detection is provided simultaneously with the formation of any one of these layers, because extra inking or printing stage other than the formation of the dye providing layers is not required.

The thermal transfer dye providing material using the thermomobile dye comprises basically a support having thereon a thermal transfer layer containing a binder and a dye which sublimes or is made mobile by heat. The thermal transfer dye providing material can be obtained by dissolving or dispersing the conventional dye (which sublimes or is made mobile by heat) and a binder resin in an appropriate solvent, coating the resulting coating solution on one side of the support for the thermal transfer dye providing material in such an amount as to give a dry thickness of about 0.2 to 5 μm, preferably 0.4 to 2 μm, and drying the coated support to form a thermal transfer layer.

Any of the dyes conventionally used for the thermal transfer dye providing material can be used as dyes for use in the formation of the thermal transfer layer. However, dyes having a low molecular weight of about 150 to 800 are particularly preferred in the present invention. Dyes to be used are chosen by taking transfer temperature, hue, light resistance, solubility or dispersibility in inks and binder resins, etc. into consideration.

Examples of the dyes include disperse dyes, basic dyes and oil-soluble dyes. Particularly preferred dyes are Sumikaron Yellow E4GL, Dianix Yellow H2G-FS, Miketon Polyster Yellow 3GSL, Kayaset Yellow 937, Sumikaron Red EFBL, Dianix Red ACE, Miketon Polyester Red FB, Kayaset Red 126, Miketon First Brilliant Blue B and Kayaset 136. Other conventional thermomobile dyes can also be used.

Further, yellow dyes described in JP-A-59-78895, JP-A-60-28451, JP-A-60-28453, JP-A-60-53564, JP-A-61-148096, JP-A-60-239290, JP A-60-31565, JP-A-60-30393, JP-A-60-53565, JP-A-60-27594, JP-A-61 262191, JP-A-60-152563, JP-A-61-244595, JP-A 62-196186, JP-A-63-142062, JP-A-63-39380, JP-A 62-290583, JP A-63-111094, JP-A-63-111095, JP-A-63-122594, JP-A-63-71392, JP-A-63-74685 and JP-A-63-74688; magenta dyes described in JP-A-60-223862, JP-A-60-28452, JP-A-60-31563, JP-A-59-78896, JP-A-60-31564, JP-A-60-303391, JP-A-61-227092, JP-A 61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-55194, JP-A-62-297593, JP-A-63-74685, JP-A-63-74688, JP-A-62-97886, JP-A-62-132685, JP-A-61-163835, JP-A-62-211190 and JP-A-62-99195; and cyan dyes described in JP-A-59-78894, JP-A-60-31559, JP-A-60-53563, JP-A-61-19396, JP-A-61-22993, JP-A-61-31467, JP-A-61-35994, JP-A-61-49893, JP-A-61-57651, JP-A-62-87393, JP-A-63-15790, JP-A-63-15853, JP-A-63-57293, JP-A-63-74685, JP-A-63-74688, JP-A-59-227490, JP-A-59-227493, JP A-59-227948, JP-A-60-131292, JP-A-60-131294, JP-A-60-151097, JP-A-60-151098, JP-A-60-172591, JP-A-60-217266, JP-A-60-239289, JP-A-60-239291, JP-A-60-239292, JP-A-61-148269, JP-A-61-244594, JP-A-61-255897, JP-A-61-284489, JP-A-61.-368493, JP-A-62-132684, JP-A-62-138291, JP-A-62-191191, JP-A-62-255187, JP-A-62-288656, JP-A-62-311190 and JP-A-63-144089 can be used.

Any of the binder resins conventionally used for the same purpose can be used as binder resins used together with dyes. Usually, binder resins which have a high heat resistance and do not interfere with the migration of the dyes ca be used. Examples of the binder resins include polyamide resins, polyester resins, epoxy resins, polyurethane resins, polyacrylic resins (e.g., polymethyl methacrylate, polyacrylamide, polystyrene-acrylonitrile), vinyl resins such as polyvinyl pyrrolidone, polyvinyl chloride resins (e.g., vinyl chloride-vinyl acetate copolymer), polycarbonate resins, polystyrene, polyphenylene oxide, cellulose resins (e.g., methyl cellulose, ethyl cellulose, carboxymethyl cellulose, cellulose acetate hydrogen phthalate, cellulose acetate, cellulose acetate propionate, cellulose acetate butyrate, cellulose triacetate), polyvinyl alcohol resins (e.g., polyvinyl alcohol, partially saponified polyvinyl alcohol such as polyvinyl butyral), petroleum resins, rosin derivatives, coumarone-indene resins, terpene resins and polyolefin resins (e.g., polyethylene, polypropylene).

These binder resins are used in an amount of preferably about 80 to 600 parts by weight per 100 parts by weight of the dye.

Any of the conventional ink solvents can be used as ink solvents for dissolving or dispersing the dyes and the binder resins in the present invention.

It is preferred that a release agent is incorporated in layers constituting the dye providing material and/or the image receiving layer to improve the releasability of the thermal transfer dye providing material and the thermal transfer image receiving material from each other. It is particularly preferred that the release agent is incorporated in the outermost layer where both materials are brought into contact with each other.

Examples of the release agent include solid or waxy materials such as polyethylene wax and amide wax; surfactants such as phosphoric esters; paraffin oil, fluorine oil and silicone oil and solid fine particles thereof; and other known release agents. However, silicone oil is particularly preferred.

Examples of the silicone oil include unmodified silicone oil and modified silicone oil such as carboxy-modified, amino-modified, polyether-modified, alkyl-modified or epoxy-modified silicone oil. More specifically, examples of the modified silicone oil are described in *Modified Silicone Oil*, pp. 6 to 18B, (technical data published by Shin-Etsu Silicone Co., Ltd.).

The layers which constitute the thermal transfer dye providing material and thermal transfer image receiving material of the present invention may be cured by hardening agents.

Hardening agents described in JP-A-61-199997 and JP-A-58-215398 can be used when organic solvent-soluble polymers are cured. Isocyanate hardening agents are particularly preferred when polyester resins are cured.

Hardening agents described in U.S. Pat. No. 4,678,739 (41st column), JP-A-59-116655, JP-A-62-245261 and JP-A-61-18942 are suitable for use in curing water-soluble polymers.

More specifically, examples of the hardening agents include aldehyde hardening agents (e.g., formaldehyde), aziridine hardening agents, epoxy resin hardening agents

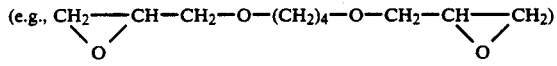

vinylsulfone hardening agents (e.g., N,N'-ethylene-bis-vinylsulfone hardening agents (e.g. (vinylsulfonylacetamido)ethane, N-methylol hardening agents (e.g., dimethylol urea) and high molecular weight hardening agents (e.g., compounds described in JP-A-62-62-234157).

The thermal transfer dye providing materials or the thermal transfer image receiving material may contain anti-fading agents. Examples of the anti-fading agents include antioxidants, ultraviolet light absorbers and various metal complexes.

Examples of the antioxidants include chroman compounds, coumaran compounds, phenol compounds (e.g., hindered phenols), hydroquinone derivatives, hindered amine derivatives and spiro-indane compounds. Further, compounds described in JP-A-61-159644 are effective.

Examples of the ultraviolet light absorbers include benztriazole compounds (U.S. Pat. No. 3,533,794), 4-thiazolidone compounds (U.S. Pat. No. 3,352,681), benzophenone compounds (JP-A-58-2784) and compounds described in JP-A-54-48535, JP-A-62-136641 and JP-A-61-88256. Ultraviolet light absorbing polymers described in JP-A-62-260152 are also effective.

Examples of the metal complexes include compounds described in U.S. Pat. Nos. 4,241,155, 4,245,018 (3rd to 36th columns) and 4,254,195 (3rd to 8th columns), JP A-62-174741, JP-A-61-88256 (pages 27 to 29), JP-A-1-75568 and JP-A-63-199248.

Examples of useful anti-fading agents are described in JP-A-62-215272 (pages 125 to 137).

The anti-fading agent may be previously incorporated in the image receiving material to prevent the dye transferred to the image receiving material from being faded. Alternatively, the anti fading agent may be fed to the image receiving material from an external source, for example, by transferring it from the dye providing material.

The above-described antioxidant, ultraviolet light absorber and metal complex may be used in combination.

The thermal transfer dye providing material or the thermal transfer image receiving material may contain matting agents. Examples of the matting agents include silicon dioxide, compounds such as polyolefins and polymethacrylates described in JP-A-51-88256 (page 29) and compounds such as benzoguanamine resin beads, polycarbonate resin beads and AS resin beads described in JP-A-63-274944 and JP-A-63-274952.

The layers of the thermal transfer dye providing material or the thermal transfer image receiving material may contain various surfactants as coating aid or for the purpose of improving releasability and slipperiness or imparting antistatic properties.

Nonionic surfactants, anionic surfactants, ampholytic surfactants and anionic surfactants can be used. Examples of these surfactants are described in JP A-62-173463 and JP-A-62-183457.

In the present invention, the thermal transfer dye providing material and the thermal transfer image receiving material are placed on each other. Heat energy according to information on the image is applied thereto from either one side, preferably the back side of the thermal transfer dye providing material by a heating means such as a thermal head, whereby the dye of the dye providing layer can be transferred to the thermal transfer image receiving material according to the intensity of heating energy. Thus, a color image having excellent sharpness and resolving gradation is obtained.

Heating means is not limited to a thermal head, but any of the conventional means such as laser beams (e.g., semiconductor lasers), infrared flash and hot pen can be used.

When the thermal transfer dye providing material is combined with the thermal transfer image receiving material, the present invention can be applied to facsimile, printing by using various thermal printing type printers or it can be applied to the preparation of the prints of images by magnetic recording systems, magneto-optical recording systems and optical recording systems or the preparation of prints from televisions and CRT screens:

The details of the thermal transfer recording method are described in JP-A-60-34895.

The present invention is now illustrated in greater detail by reference to the following examples which, however, are not to be construed as limiting the invention in any way.

EXAMPLE 1

Preparation of Thermal Transfer Dye Providing Material (A)

Polyethylene terephthalate film (Lumirror, a product of Toray Industries, Inc.) having a thickness of 4.5 μm and a heat-resistant slipping layer composed of a thermosetting acrylic resin on one side thereof was used as a support. The other side (the side opposite to the heat resistant slipping layer side) of the support was coated with the following coating composition (A) for forming a thermal transfer dye providing layer by means of wire bar coating in such an amount as to give a dry thickness of 2 μm to form a thermal transfer dye providing layer. The back side of the support was coated with a slipping layer comprising polyvinyl butyral (0.45 g/m$^2$, Butvar 76 manufactured by Monsanto Chemical Co.) and poly(vinyl stearate) (0.3 g/m$^2$) from a tetrahydrofuran solution to obtain a thermal transfer dye providing material (A)

Coating Composition (A) for Forming Thermal Transfer Dye Providing Layer

| | |
|---|---|
| Disperse dye (2,3-diphenoxyanthraquinone) | 4 g |
| Polyvinyl butyral resin (Denka Butyral 5000-A manufactured by Denki Kagaku Kogyo KK) | 4 g |
| Methyl ethyl ketone | 40 ml |
| Toluene | 40 ml |
| Polyisocyanate (Takenate D110N manufactured by Takeda Chemical Industries, Ltd.) | 0.2 ml |

Preparation of Thermal Solvent Emulsion A

| | |
|---|---|
| Solution I: | |
| Lime processed gelatin (10 wt % aqueous solution) | 100 g |
| Sodium dodecylbenzenesulfonate (5 wt % aqueous solution) | 20 ml |
| Solution II: | |
| Thermal solvent (Compound 7) | 30 g |
| Ethyl acetate | 30 ml |

Solution II was mixed with Solution I heated to 40° C. The mixture was then stirred in a homogenizer at 15,000 rpm for 10 minutes to prepare Emulsion A.

Preparation of Thermal Solvent/Dye Accepting Polymer Dispersion B

| | |
|---|---|
| Solution I: | |
| Lime-processed gelatin (10 wt % aqueous solution) | 80 g |
| Saturated polyester latex (Vylonal MD-1200 manufactured by Toyobo Co., Ltd.) | 100 g |
| Sodium dodecylbenzenesulfonate (5 wt % aqueous solution) | 5 ml |
| Solution II: | |
| Thermal solvent (Compound 7) | 10 g |
| Polyether epoxy-modified silicone oil (SF8421 manufactured by Toray Silicone Co., Ltd.) | 2 g |
| Ethyl acetate | 10 ml |

Solution II was mixed with Solution I heated to 40° C. The mixture was then stirred in a homogenizer at 15,000 rpm for 10 minutes to prepare Dispersion B.

Preparation of Thermal Transfer Image Receiving Material 100

| Coating Solution | |
|---|---|
| Lime-processed gelatin (10 wt % aqueous solution) | 100 g |
| Saturated polyester latex (Vylonal | 100 g |

-continued

| Coating Solution | |
|---|---|
| MD-1200 manufactured by Toyobo Co., Ltd.) | |
| Thermal solvent (Emulsion A) | 50 g |
| Polyether epoxy-modified silicone oil (SF8421 manufactured by Toray Silicone Co., Ltd.) | 2 g |
| Surfactant (1)* [5% solution (water/methanol = 1/1 by volume)] | 6 ml |
| Hardening Agent (1)* (4 wt % aqueous solution) | 12 ml |

Hardening Agent (1)* and Surfactant (1)* were the following compounds (identical hereinafter).

Hardening Agent (1)*:
1,2-bis(vinylsulfonylacetamido)ethane

Surfactant (1)*:

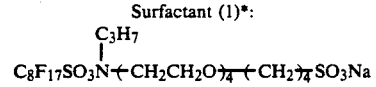

Both sides of a paper having a basis weight of 180 g/m$^2$ were laminated with polyethylene containing titanium oxide dispersed therein. The polyethylene-laminated paper was used as a support. The support was coated with the above-described coating solution in such an amount as to give a wet film thickness of 70 ml/m$^2$. The coated support was dried to prepare Thermal Transfer Image Receiving Material 100.

Preparation of Thermal Transfer Image Receiving Material Coating Solution

| Coating Solution | |
|---|---|
| Dispersion B | 100 g |
| Surfactant (1)* [5% solution (water/methanol = 1/1 by volume)] | 6 ml |
| Hardening Agent (1)* (4 wt % aqueous solution) | 10 ml |

Both sides of a paper having a basis weight of 180 g/m$^2$ were laminated with polyethylene containing titanium oxide dispersed therein. The polyethylene-laminated paper was used as a support. The support was coated with the above coating solution in such an amount as to give a wet film thickness of 70 ml/m$^2$. The coated support was dried to prepare Thermal Transfer Image Receiving Material 101.

Preparation of Thermal Transfer Image Receiving Material 102

Thermal Transfer Image Receiving Material 102 was prepared in the same way as in the preparation of Thermal Transfer Image Receiving Material 100 except that 50 ml of water was used in place of the thermal solvent, Emulsion A.

Preparation of Thermal Transfer Image Receiving Material 103

| Coating Solution | |
|---|---|
| Saturated polyester latex (Vylonal MD 1200 manufactured by Toyobo Co., Ltd.) | 100 g |
| Surfactant (1)* [5% solution (water/methanol = 1/1 by volume)] | 6 ml |
| Hardening Agent (1)* (4 wt % aqueous solution) | 12 ml |

-continued

Both sides of a paper having a basis weight of 180 g/m$^2$ were laminated with polyethylene containing titanium oxide dispersed therein. The polyethylene-laminated paper was used as a support. The support was coated with the above coating solution in such an amount as to give a wet film thickness of 35 ml/m$^2$. The coated support was dried to prepare Thermal Transfer Image Receiving Material 103.

Preparation of Thermal Transfer Image Receiving Material 104

Thermal Transfer Image Receiving Material 104 was prepared in the same way as in the preparation of Thermal Transfer Image Receiving Material 103 except that Hardening Agent (1)* was omitted.

Preparation of Thermal Transfer Image Receiving Material 105

Thermal Transfer Image Receiving Material 105 was prepared in the preparation of Thermal Transfer Image Receiving Material 101 except that an equal amount of water was used in place of the aqueous solution of lime-processed gelation used for the preparation of Dispersion B.

The thus-obtained thermal transfer dye providing material and each of the thus-obtained thermal transfer image receiving materials were put upon each other in such a manner that the dye providing layer and the image receiving layer were brought into contact with each other. Printing was carried out from the support side of the thermal transfer dye providing material by using a thermal head under such conditions that the output of the thermal head was 0.25 W/dot, the pulse width was 0.15 to 15 msec and the dot density was 6 dots/mm. Magenta dye was imagewise deposited on the image receiving layer of the thermal transfer image receiving material.

Performance Evaluation

Reflection Density

The reflection density of an area (Dmax) where the density of the resulting recorded thermal transfer image receiving material was saturated was measured with a Macbeth reflection densitometer.

Blur of Image with Time

After the recorded image receiving material was stored at 60° C. in a thermostat for 2 weeks, the degree of blur of image was examined. The criterion of evaluation on blur of image with time is as follows.

○: not smeared
Δ: slightly smeared
x: greatly smeared

Heat Fusion

Thermal transfer was carried out in the same way as in the aforesaid operation except that the output of the thermal head was 0.3 W/dot. The heat fusion of the dye providing layer of the thermal transfer dye providing material to the thermal transfer image receiving material was examined. The criterion of evaluation on heat fusion is as follows.

○: not fused by heat
Δ: partially fused by heat
x: considerably fused by heat
The results are shown in Table 1.

TABLE 1

| Thermal Transfer Image Receiving Material | Dye Accepting Polymer Latex | Water-Soluble Binder | Thermal Solvent (Other) | Evaluation Results: Reflection Density | Heat Fusion | Blur of Image with Time |
|---|---|---|---|---|---|---|
| 100 (Invention | Vylonal MD-1200 | Gelatin | Compound 7 | 1.52 | ○ | ○ |
| 101 (invention) | Vylonal MD-1200 | Gelatin | Compound 7 (dispersed simultaneously with latex) | 1.67 | ○ | ○ |
| 102 (Comp. Ex.) | Vylonal MD-1200 | Gelatin | omitted | 1.08 | ○-Δ | ○ |
| 103 (Comp. Ex.) | Vylonal MD-1200 | omitted | omitted | 1.11 | Δ-x | ○ |
| 104 (Comp. Ex.) | Vylonal MD-1200 | omitted | omitted (no hardener) | 1.05 | x | ○ |
| 105 (Comp. Ex.) | Vylonal MD-1200 | omitted | Compound No. 7 (dispersed simultaneously with latex) | 1.65 | x | x |

It is apparent from the evaluation results of Table 1 that in the Comparative Examples (Image Receiving Materials 103 and 104), a sufficient image density cannot be obtained and the property with regard to heat fusion is poor. In the Comparative Example (Image Receiving Material 102), a sufficient image density cannot be obtained, though the property with regard to heat fusion is improved.

In the Comparative Example (Image Receiving Material 105), the properties with regard to heat fusion and the blur of image are poor, though an image having a high density can be obtained.

In Receiving Materials 100 and 101 wherein the fine particles of the dye receiving polymer and the thermal solvent are dispersed in the water-soluble binder according to the present invention, heat fusion is scarcely caused and an image having a high density can be obtained. Further, the image formed is scarcely blurred with time.

EXAMPLE 2

Preparation of Thermal Solvent/Dye Accepting Polymer Dispersion C

| | |
|---|---|
| Solution I: | |
| Lime-processed gelatin | 80 g |
| (10 wt % aqueous solution) | |
| Dispersion of fine particles of dye accepting polymer (indicated in Table 2) | x g |
| Sodium dodecylbenzenesulfonate (5 wt % aqueous solution) | 5 ml |
| Solution II: | |
| Thermal solvent (indicated in Table 2) | y g |
| Epoxy-modified silicone oil (KF-100T manufactured by Shin-Etsu Silicone Co., Ltd.) | 2 g |
| Ethyl acetate | 10 ml |

Solution II was mixed with Solution I heated to 40° C. The mixture was then stirred in a homogenizer at 15,000 rpm for 10 minutes to prepare Dispersion C.

Preparation of Thermal Transfer Image Receiving Materials 200 to 216

Thermal Transfer Image Receiving Materials 200 to 212 were prepared in the same way as in the preparation of Thermal Transfer Image Receiving Material 101 except that thermal solvent compounds and dye accepting polymers indicated in Table 2 were used.

The thermal transfer dye providing material was prepared in the same way as in Example 1.

In the same way as in Example 1, transfer and performance evaluation were made by using the thus prepared thermal transfer image receiving materials and the thermal transfer dye providing material. The results are shown in Table 2.

TABLE 2

| Thermal Transfer Image Receiving Material | Fine Particles of Dye Accepting Polymer: Polmer | X (g) | Thermal Solvent: Compound | y (g) | Performance Evaluation: Dmax | Heat Fusion | Blur of Image with Time |
|---|---|---|---|---|---|---|---|
| 200 (Comp. Ex.) | Vylonal MD-1200 (Solids content: 40 wt %) | 100 | — | — | 1.05 | ○-Δ | ○ |
| 201 (Comp. Ex.) | Pesresin-1243 (Solids content: 125 wt %) | 160 | — | — | 1.15 | ○-Δ | ○ |
| 202 (Comp. Ex.) | Perresin-1231G (Solids content: 25 wt %) | 160 | — | — | 1.01 | ○-Δ | ○ |
| 203 (Comp. Ex.) | Polyurethane Emulsion S-1060* | 100 | — | — | 1.00 | ○-Δ | ○ |
| 204 (Invention) | Vylonal MD-1200 (Solids content: 40 wt %) | 100 | Compound 14 | 10 | 1.70 | ○ | ○ |
| 205 (Invention) | Pesresin-1243 (Solids content: | 160 | " | 10 | 1.76 | ○ | ○ |

TABLE 2-continued

| Thermal Transfer Image Receiving Material | Fine Particles of Dye Accepting Polymer | | Thermal Solvent | | Performance Evaluation | | |
|---|---|---|---|---|---|---|---|
| | Polmer | X (g) | Compound | y (g) | Dmax | Heat Fusion | Blur of Image with Time |
| | 25 wt %) | | | | | | |
| 206 (Invention) | Pesresin-1231G (Solids content: 25 wt %) | 160 | " | 10 | 1.59 | ○ | ○ |
| 207 (Invention) | Polyurethane Emulsion S-1060* | 100 | Compound 14 | 10 | 1.43 | ○ | ○ |
| 208 (Invention) | Vylonal MD-1200 (Solids content: 40 wt %) | 100 | Compound 8 | 10 | 1.61 | ○ | ○ |
| 209 (Invention) | Vylonal MD-1200 (Solids content: 40 wt %) | 100 | Compound 6 | 10 | 1.43 | ○ | ○ |
| 210 (Invention) | Vylonal MD-1200 (Solids content: 40 wt %) | 100 | Compound 5 | 10 | 1.58 | ○ | ○ |
| 211 (Invention) | Vylonal MD-1200 (Solids content: 40 wt %) | 100 | Compound 14 | 5 | 1.47 | ○ | ○ |
| 212 (Invention) | Vylonal MD-1200 (Solids content: 40 wt %) | 100 | " | 2.5 | 1.28 | ○ | ○ |
| 213 (Invention) | Pesresin-1243 (Solids content: 25 wt %) | 100 | Compound 2 | 10 | 1.18 | ○ | ○ |
| 214 (Invention) | Pesresin-1243 (Solids content: 25 wt %) | 100 | Compound 22 | 10 | 1.19 | ○ | ○ |
| 215 (Invention) | Pesresin-1243 (Solids content: 25 wt %) | 100 | Compound 38 | 10 | 1.41 | ○-Δ | ○ |
| 216 (Invention) | Pesresin-1243 (Solids content: 25 wt %) | 100 | Compound 39 | 10 | 1.30 | ○ | ○ |

*Polyurethane emulsion S-1060 manufactured by Hodogaya Chemical Co., Ltd.

In Thermal Transfer Image Receiving Materials 215 and 216, the surface gloss was lost.

It is apparent from the evaluation results of Table 2 that in the thermal transfer image receiving materials of the present invention, a dye transfer image having a high density can be obtained without problems with heat fusion and the preservability of the transfer image with time is good.

According to the present invention, there can be obtained the thermal transfer image receiving materials which have excellent manufacturability without problems with heat fusion during thermal transfer. When the thermal transfer image receiving materials are used, the transfer image having a high density and excellent preservability with time can be obtained.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support having thereon at least one image receiving layer capable of accepting a dye which migrates from a thermal transfer dye providing material when heated, to form an image, wherein said image receiving layer is formed by coating a coating solution and drying it, said coating solution being obtained by dispersing an aqueous dispersion of fine particles of a dye accepting polymer and a high-boiling organic solvent and/or a thermal solvent in a water-soluble binder solution, wherein the high-boiling organic solvent and/or thermal solvent are selected from the group consisting of esters, amides, ethers, or alcohols.

2. The thermal transfer image receiving material of claim 1, wherein said fine particles of a dye accepting polymer have a particle diameter of 5 μm or less.

3. The thermal transfer image receiving material of claim 1, wherein said high-boiling organic solvent and/or thermal solvent have an organic character/inorganic character value ≧2.

4. The thermal transfer image receiving material of claim 1, wherein the water-soluble binder and the dye accepting polymer are used in a weight ratio of the dye accepting polymer to the water-soluble polymer of from 1 to 20.

5. The thermal transfer image receiving material of claim 1, wherein said high-boiling organic solvent and/or thermal solvent. is used in an amount of 1 to 300% by weight based on the amount of the water-soluble binder.

6. The thermal transfer image receiving material of claim 1, wherein the total thickness of said image receiving layer is in the range of from 0.5 to 50 μm.

7. The thermal transfer image receiving material of claim 1, wherein when said image receiving layer is composed of two or more layers, the thickness of an outermost layer is in the range 0.1 to 3 μm.

8. The thermal transfer image receiving material of claim 1, wherein said image receiving layer further includes an interlayer with or without a water-soluble binder between said support and said image receiving layer.

9. The thermal transfer image receiving material of claim 8, wherein when said image receiving layer is provided on both sides of said support, the thickness of said interlayer is in the range of from 0.5 to 50 μm.

10. The thermal transfer image receiving material of claim 1, wherein the esters are selected from the group consisting of phthalic esters, phosphoric esters, and fatty acid esters.

11. The thermal transfer image receiving material of claim 1, wherein the amides are selected from the group consisting of fatty acid amides and sulfonamides.

12. The thermal transfer image receiving material of claim 1, wherein the ester is a benzoic acid ester.

13. The thermal transfer image receiving material of claim 12, wherein the benzoic acid ester is selected from the group consisting of

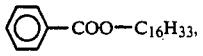

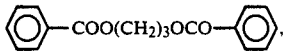

-continued

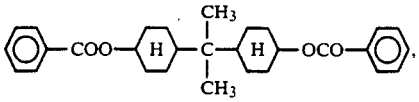

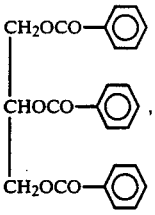

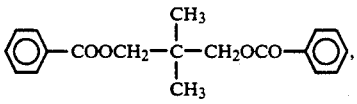

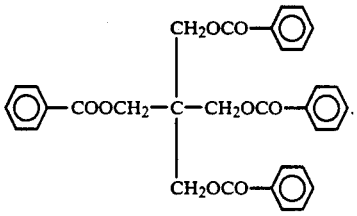

* * * * *